United States Patent [19]

Gombas

[11] 4,070,888

[45] Jan. 31, 1978

[54] APPARATUS AND METHODS FOR SIMULTANEOUSLY NECKING AND FLANGING A CAN BODY MEMBER

[75] Inventor: Laszlo Attila Gombas, Evergreen, Colo.

[73] Assignee: Coors Container Company, Golden, Colo.

[21] Appl. No.: 772,480

[22] Filed: Feb. 28, 1977

[51] Int. Cl.[2] ..... B21D 19/06

[52] U.S. Cl. ..... 72/91; 72/105; 72/110; 113/120 AA

[58] Field of Search ..... 72/84, 91, 105, 106, 72/110; 113/120 AA

[56] References Cited

U.S. PATENT DOCUMENTS

| | | | |
|---|---|---|---|
| 1,873,164 | 8/1932 | Turnquist | 72/105 |
| 2,170,946 | 8/1939 | Greif | 72/106 |
| 3,688,538 | 9/1972 | Hoyne | 113/120 AA |
| 3,754,424 | 8/1973 | Costanzo | 72/105 |
| 3,765,351 | 10/1973 | Kubacki et al. | 113/120 AA |
| 3,782,314 | 1/1974 | Franek et al. | 113/120 AA |

*Primary Examiner*—Lowell A. Larson
*Attorney, Agent, or Firm*—Bruce G. Klaas

[57] ABSTRACT

Apparatus and methods for simultaneously necking and flanging an unformed end portion next adjacent a rim portion of a cylindrical side wall portion of a sheet metal can body member to form a curved necked-in wall portion in the unformed end portion next adjacent and connected to the side wall portion and to form a radially and axially outwardly extending flange portion between the formed curved necked-in portion and the rim portion comprising:

means for rotatably supporting the can body member during the necking and flanging operation;

outer forming means mounted without the can body member in radially outwardly spaced relationship to and in axial alignment with the unformed end portion and having a curved annular outer forming surface extending therearound for engaging the outer peripheral surface of the unformed end portion to form the curved necked-in portion;

inner forming means mounted within the can body member in radially inwardly spaced relationship to and in axial alignment with the unformed end portion and having first and second axially oppositely displaceable annular inner forming surfaces for engaging axially spaced portions of the inner peripheral surface of the unformed end portion located on axially opposite sides of the center of curvature of the curved annular outer forming surface to form the curved necked-in portion and the flange portion while preventing radial inward displacement of the rim portion; and actuating means for causing relative rotational movement between the can body member and the outer forming means and for causing relative radial displacement therebetween to engage the annular outer forming surface with the outer peripheral surface of the unformed end portion and progressively move the annular outer forming surface radially inwardly relative to the can body member until the curved necked-in portion and the flange portion have been formed in the unformed end portion.

20 Claims, 14 Drawing Figures

APPARATUS AND METHODS FOR SIMULTANEOUSLY NECKING AND FLANGING A CAN BODY MEMBER

BACKGROUND AND SUMMARY OF THE INVENTION

This invention relates to new and improved methods and apparatus for forming a necked-in portion and attachment flange on a metallic can body.

In the manufacture of two and three piece can type containers from metallic sheet material such as steel, steel alloys, and aluminum, a can body member of generally cylindrical shape is formed with both ends open (for three piece cans), or with only one end open (for two piece cans). In order to close the open end/s of the can body, portions of the can body adjacent the open end/s are necked down and an attachment flange portion is formed at the end/s of the can body. The attachment flange portion is utilized for sealing association with an end plate member to close the open end/s of the can body to form a can with contents such as beer or soft drinks sealed therewithin.

It has been common commercial practice to first separately perform the necking operation by separate necking apparatus and methods such as disclosed in U.S. Pat. No. 3,687,098 of John Hardy Maytag, issued Aug. 29, 1972, and owned by the assignee of the present invention. Other United States patents relating to necking apparatus and methods include: U.S. Pat. Nos. 3,898,828; 3,831,416; 3,820,486; 3,812,696; 3,808,868; 3,786,957; 3,797,431; 3,771,476; 3,763,807; 3,757,558; 3,690,279; 3,680,350; 3,600,927 and 3,468,153. After completion of the separate necking operation, it has been common commercial practice to then separately perform a flanging operation by separate flanging apparatus and methods as illustrated in U.S. Pat. Nos. 3,548,769 and 3,406,648. While necking and flanging apparatus and methods have been proposed for simultaneous necking and flanging operations, as illustrated by U.S. Pat. Nos. 3,951,083; 3,797,429; 3,782,315; 3,782,314; 3,765,351; 3,757,555; 3,698,337 and 3,688,538, the applicants are unaware of any successful commercial usage of such simultaneous necking and flanging apparatus and methods.

Forming of the attachment flange portion is a critical operation in manufacture of a can having good sealing characteristics. In addition, substantial savings in cost of sheet materials may be effected by reduction of the diameters of the can flange portion and the end plate members. Many present commercially available cans have substantially uniform diameter can body members and end plate members. However, it has been determined that by use of the present invention the attachment flange portion of the can body member may be more easily formed with a diameter enabling the use of an end plate member of smaller diameter than the diameter of the main sidewall portion of the can body member. The satisfactory formation of an attachment flange portion of suitable diameter has been difficult and many problems have been encountered in developing methods and apparatus for relatively high speed reliable defect-free manufacture thereof.

The present invention solves many of those problems by providing a method and apparatus for forming an attachment flange portion by use of rotatable housing means having a rotatable self centering sleeve means for receiving a can body member therewithin; an outer forming means mounted on and rotatable with the rotatable housing means and having an annular curved outer forming surface engageable with the outer peripheral surface of an unformed end portion of the side wall portion of the can body member adjacent the rim portion; the first rotatable inner forming means for location within the can body member having a support surface in supporting engagement with only a portion of the sidewall of the can body member axially inwardly spaced from the curved outer forming surface and a first inner forming surface opposite the area of forming engagement between the curved outer forming surface and the unformed end portion of the can body member; a second rotatable inner forming means for partial location within the can body member having a support surface in supporting engagement with the rim portion of the can body member and a second inner forming surface opposite the area of forming engagement between the curved outer forming surface and the unformed end portion; and adjustment means for permitting axial separation of the first and second inner forming means during the forming operation.

IN GENERAL

Figure 1:
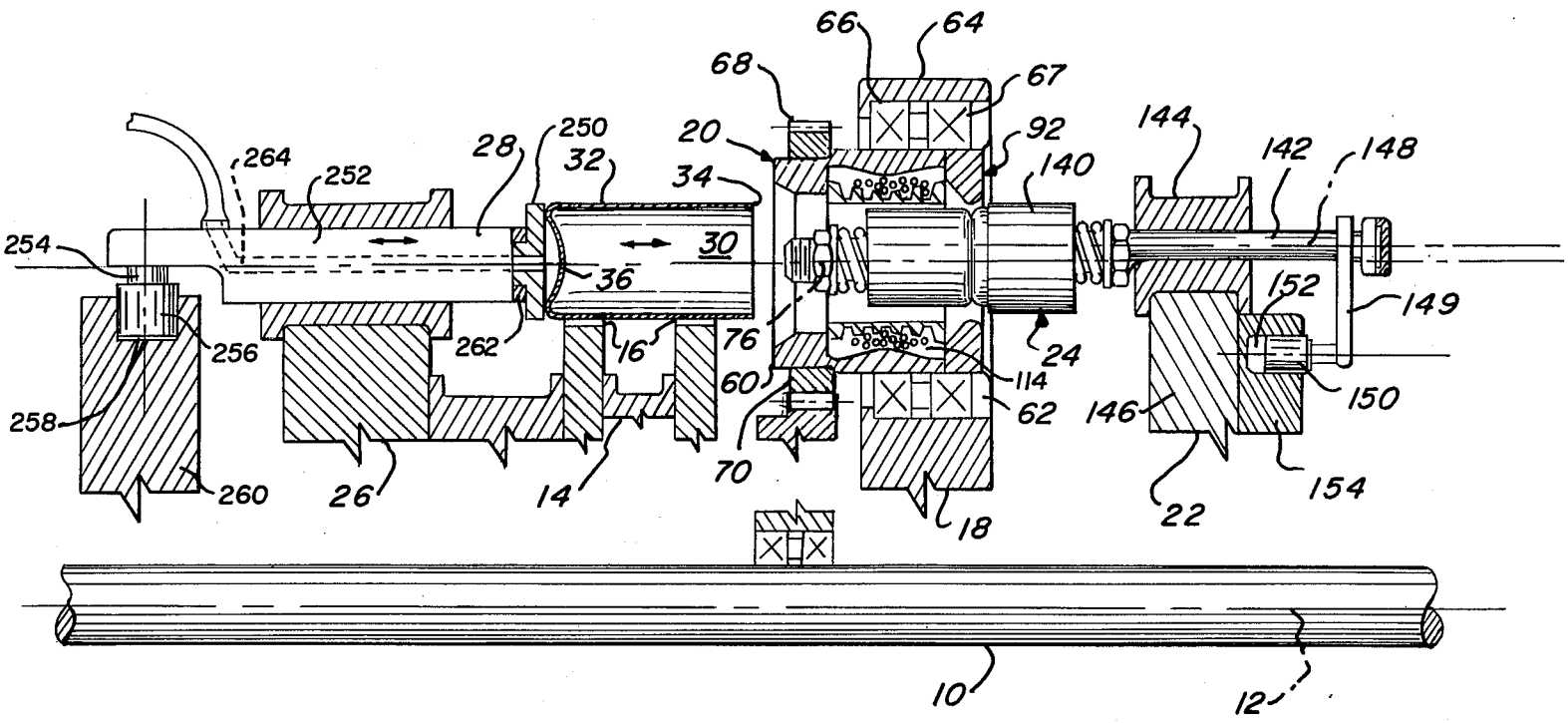
FIG. 1 is a schematic partial side elevational view, partly in cross-section, of an illustrative embodiment of the apparatus of the present invention.

Referring to FIG. 1, in general, the apparatus comprises a continuously rotatable center shaft means 10, having a central axis of rotation 12, which is rotatably supported by suitable conventional bearing and machine components (not shown) and rotatably driven by suitable conventional motor means (not shown). A conventional annular star wheel type rotary transfer wheel assembly 14, having a plurality of circumferentially spaced can body member receiving and supporting pockets 16, is fixedly mounted on the shaft 10 for continuous rotation therewith. An annular outer forming means support wheel assembly 18, which carries a plurality of circumferentially spaced outer forming means assemblies 20, is fixedly mounted on the shaft 10 for continuous rotation therewith in axially spaced relationship to and next adjacent one side of the transfer wheel assembly 14, and arranged so that there is one forming means assembly 20 continuously coaxially aligned with each pocket 16. An annular inner forming means support wheel assembly 22, which carries a plurality of circumferentially spaced inner forming means assemblies 24, is fixedly mounted on the shaft 10 for continuous rotation therewith in axially spaced relationship to and next adjacent the wheel assembly 18, and arranged so that there is one inner forming means assembly continuously generally coaxially aligned with each pocket 16 and associated outer forming means assembly 20. A conventional annular ram support wheel assembly 26, which carries a plurality of circumferentially spaced axial transfer ram assemblies 28, is fixedly mounted on shaft 10 for continuous rotation therewith in axially spaced relationship to and next adjacent the other side of the transfer wheel assembly 14, and arranged so that there is one ram assembly 28 continuously coaxially aligned with each pocket 16.

Figure 2:
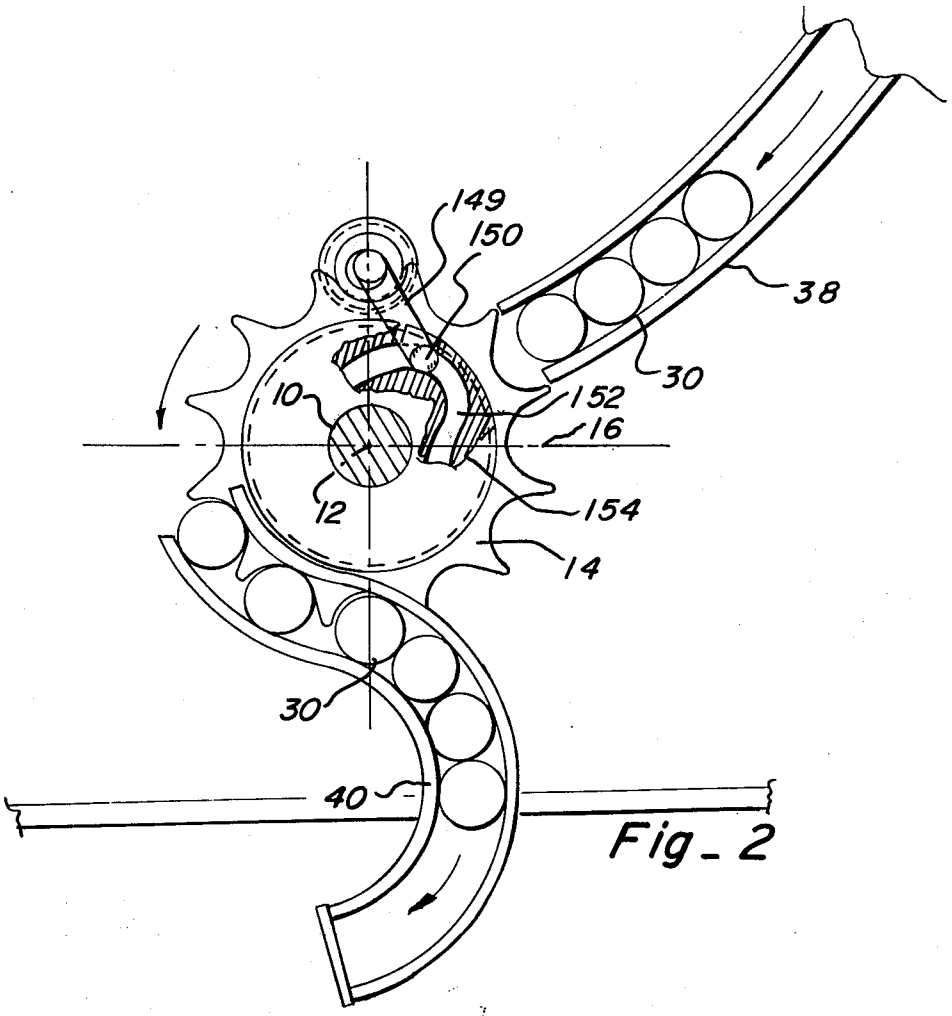
FIG. 2 is a schematic partial end view of the apparatus of FIG. 1.

The apparatus is adapted to neck and flange can body members 30 which, in the illustrative embodiment and prior to the necking and flanging operation, comprise a cylindrical sidewall portion 32, terminating at one end in an unformed open end rim portion 34, and a bottom end wall portion 36 which may be inwardly domed. As shown schematically in FIG. 2, can body members 30 are continuously loaded into empty pockets 16 on the continuously rotating transfer wheel assembly 14 by conventional gravity type loading chute means 38 and, after completion of the necking and flanging operation during a portion of one revolution of the transfer wheel assembly 14, as hereinafter described, are continuously unloaded by conventional unloading chute means 40.

Figure 3:
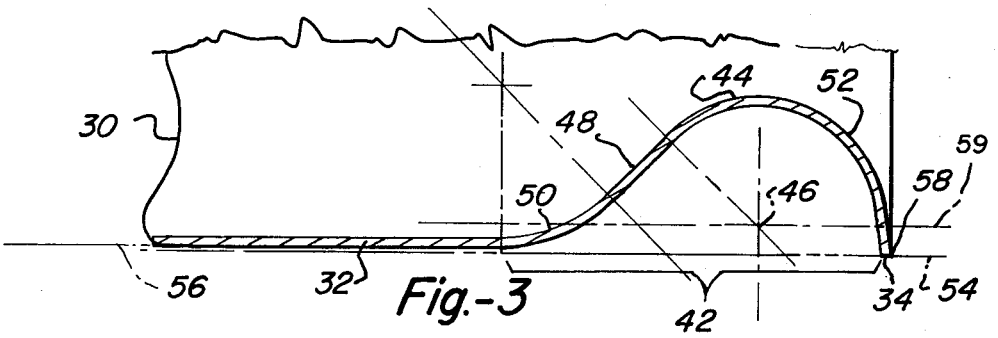
FIG. 3 is a partial side elevational cross-sectional view of a container body member formed in accordance with the present invention.

Referring now to FIG. 3, after the necking and flanging operation, as hereinafter described, the relatively short axial length, e.g. 0.225 inch, formed end portion 42 of the can body member 30 is provided with a curved annular necked-in portion 44 having a center of curvature at 46 located radially inwardly of the side wall portion 32 and connected thereto by an axially inwardly radially outwardly extending conical flange portion 48 and an annular curved portion 50. The necked-in portion 44 is connected to the annular rim portion 34 by an axially outwardly radially outwardly extending curved attachment flange portion 52, which may have the same radius and center of curvature 46 as the necked-in portion 44. The rim portion 34, which is turned radially outwardly approximately 90° or less during the forming operation and located in a plane 54 closely adjacent, e.g., 0.0075 inch, the plane 56 of the outer peripheral surface of the side wall portion 32, is connected to the curved attachment flange portion 52 by a relatively short length transverse outermost flange portion 58 extending substantially radially outwardly between the plane 59 of center of curvature 46 and the plane 54 of rim portion 34.

Figure 4:
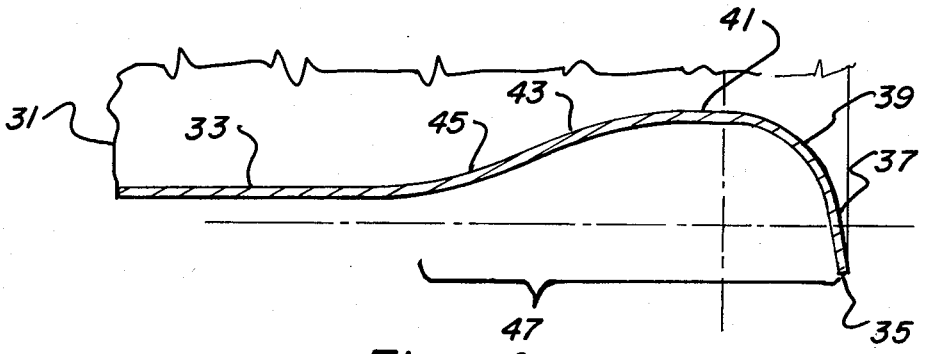
Fig 4 PRIOR ART
FIG. 4 is a partial side elevational cross-sectional view of a container body member formed in accordance with prior art apparatus and methods.

Referring now to FIG. 4, an illustrative conventional prior art necked and flanged can body member 31 having a side wall portion 33 is shown to comprise a rim portion 35 located substantially, e.g., 0.109 inch, radially outwardly of the outer surface of the side wall portion 33 and connected thereto by a first inclined flange portion 37, a second curved portion 39, a third short length annular cylindrical portion 41, a fourth curved portion 43 of a relatively large radius of curvature, and a fifth curved portion 45 of a relatively large radius of curvature. As illustrated in FIGS. 3 and 4, the axial length of the formed end portion 42 is substantially less, e.g., 0.225 inch, than the relatively long axial length, e.g., 0.30 inch, of the formed end portion 47.

The construction of FIG. 3 enables a conventional can end member (not shown) of smaller diameter than the diameter of side wall portion 32 to be sealingly associated with the curved annular portion 44, the curved flange portion 52, the radially extending flange portion 58, and the rim portion 34 by a conventional seaming operation involving radial and axial inward rolling and crimping thereof. In the construction of FIG. 4, the can end member attached to the end portion 35 and flange portions 37, 39, 41 has a diameter approximately equal to the diameter of side wall portion 33. Thus the construction of FIG. 3 not only enables more reliable forming without defects such as flange cracks but also enables substantial material savings by reduction in diameter of the end member to be associated therewith and by reduction in length of the formed end portion.

OUTER SURFACE FORMING ASSEMBLY MEANS

Referring now to FIG. 1, each of the outer surface forming assembly means 20 comprises rotatable housing means 60 rotatably supported in an annular opening 62 in the periphery of a wheel member 64, fixed to and rotatable with the center shaft 10, by suitable bearing means 66, 67. A first drive means in the form of an annular pinion gear member 68, is fixedly mounted on the housing means 60 and operatively connected to a second drive means, in the form of an annular bull gear member 70, suitably mounted on the center shaft 10 to cause continuous rotation of the housing means 60 relative to the wheel member 64.

Figure 5:
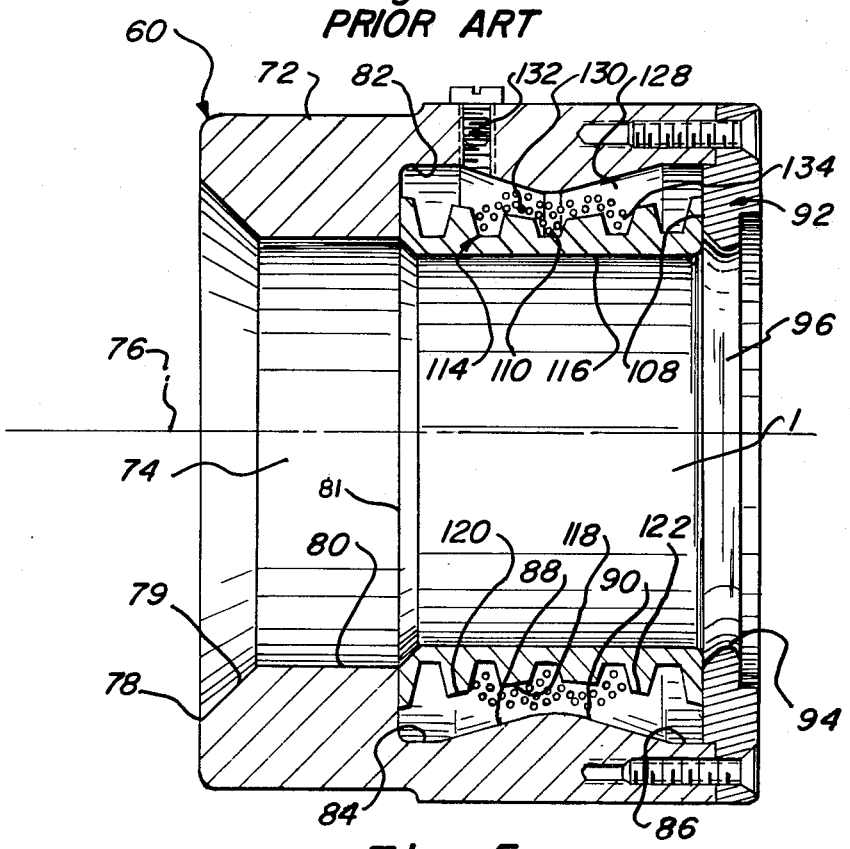
FIG. 5 is a side elevational cross-sectional view of a portion of the apparatus of FIG. 1 for forming the container body member of FIG. 3.
Figure 6:
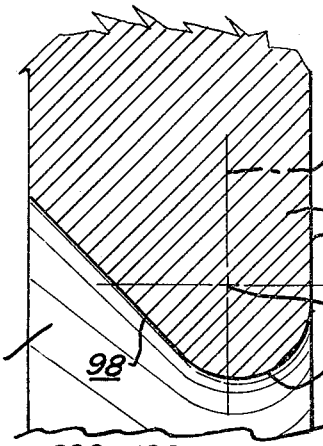
FIG. 6 is an enlarged cross-sectional side elevational view of the outer forming surface portion of the outer forming member of the apparatus of FIG. 5.
Figure 7:
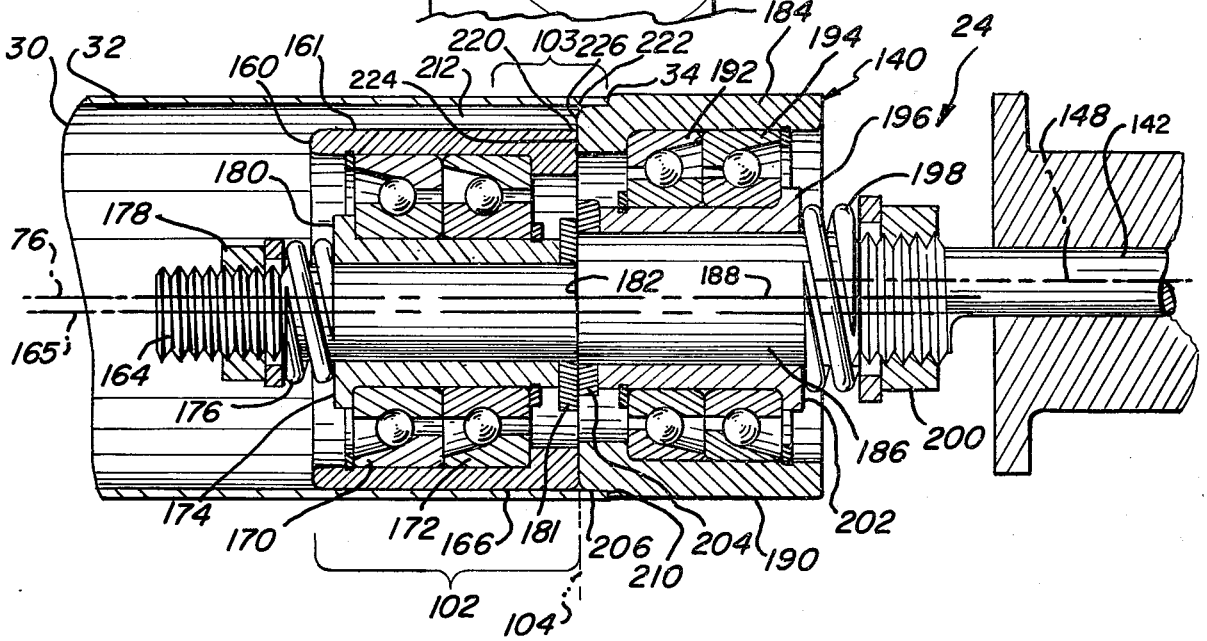
FIG. 7 is a cross-sectional side elevational view of a portion of the apparatus of FIG. 1 showing an unformed can body member in association with the inner forming and support members prior to the necking and flanging operation.

Referring now to FIGS. 5–7, the housing means 60 comprises a cylindrical housing member 72 having a stepped central bore 74 with a central axis 76. The opening end 78 of bore 74 next adjacent the transfer wheel, is substantially larger than the outside diameter of the can body member and is connected by a radially inwardly tapered bore portion 79 toward an intermediate bore portion 80 of smallest diameter and larger than the outside diameter of the can body member 30. Minimum diameter bore portion 80 is connected by a radially outwardly extending annular surface 81 to an enlarged bore portion 82 having a contoured sidewall surface comprising flat cylindrical end surface portions 84, 86 and oppositely radially inwardly inclined central surface portions 88, 90.

The outer surface forming means further comprises ring member 92 fixedly mounted on the end of housing member 72, next adjacent the wheel assembly 22, and having an annular curved outer forming surface 94 provided on the inner periphery of the ring member and defining a central cylindrical bore 96 coaxial with bore 74. As shown in FIG. 6, the forming surface cross-section comprises a first inclined flat radially inwardly axially outwardly tapered surface portion 98, a rounded radially innermost surface portion 100, of relatively large radius of curvature having a center at 101, and a straight flat radially inwardly extending side surface portion 102.

The curved surface 100 may be of compound curvature or have such other configurations as necessary or desireable to obtain particular configuration during the necking and flanging operation. In the illustrative embodiment, the center of curvature 101 is located in a radial plane 104 which includes the radially innermost point of the surface 94 and thus, also, the radially innermost point on the necked-in portion 44 of the formed can body member.

As shown in FIG. 5, the inner side surface 108 of ring member 92 is located in axially spaced parallel relationship with side surface 81 of housing member 72 to define an annular slot 110 radially inwardly circumjacent surfaces 84, 86, 88, 90 of bore 74. A self-centering sleeve means in the form of a cylindrical sleeve member 114, having an axially elongated cylindrical inner peripheral surface 116 of a diameter slightly larger than the outside diameter of the can body member and being concentrically alignable with central axis 76 of bore 74 and forming surface 94, for supporting a major portion of the side wall portion of the can body member axially inwardly of the unformed end portion is radially movably mounted and axially confined in slot 110 by surfaces 81, 108. The outer peripheral surface 118 of sleeve member 114 has radially inwardly inclined surfaces 120, 122, generally corresponding to the contour of surfaces 88, 90 and located in radially inwardly spaced relationship thereto to define an annular cavity 128. Adjustable load bearing means, in the form of a multitude of small radially and axially displaceable ball members 130 substantially fill and are confined within the cavity 128, for radial and axial displacement therewithin and for radially movably supporting the ring member 116 relative to the housing member 72 while establishing contact between the cylindrical surface 116 of the ring member 114 and the outer peripheral surface of the can body member. The ball members are of relatively small diameter, e.g., 0.125 inch, and may be made of a relatively hard durable material such as a chromium alloy. A suitable closeable opening 132 is provided in the housing member 72 for insertion of the ball members. In order to assure uniform load bearing and force transfer conditions on the sleeve member 114, the surfaces 120, 122 may be provided with annular tapered grooves 134 as illustrated on the upper half of the sleeve member in FIG. 5. The arrangement is such that sleeve member 114 is normally located in coaxial relationship to central axis 74 by the effect of centrifugal force during rotation of housing member 72 while being rotatable and radially outwardly displaceable relative to the housing member 72 and the forming surface 94.

INNER FORMING ASSEMBLY MEANS

Referring now to FIG. 1, each of the inner surface forming assembly means 24 comprises rotatable annular forming means 140 rotatably mounted on one end of a support shaft means 142 so as to be located within the sleeve member 114 in the housing member 60 and the forming ring member 92. Shaft means 142 is rotatably supported in suitable bearing means 144 on the periphery of a tool wheel 146 fixed to and rotatable with the center shaft 10. The central axis 148 of shaft means 142 is eccentrically located relative to the coaxial central axes 76 of the die housing means 60, the sleeve member 114, and the forming ring means 92. The shaft means 142 is connected to shaft rotation actuating means in the form of a cam follower arm 149 having a cam roller member 150 mounted in a cam groove 152 in a cam plate member 154 non-rotatably fixed relative to the center shaft 10.

Referring to FIGS. 7–10, the inner forming means 140 comprises an axially innermost first forming member 160 having a cylindrical support surface 161, with an outside diameter substantially less than the inside diameter of the can body member 30 and extending axially inwardly from approximately the plane 104 of the center of curvature 101 of the outer forming surface 94 to an axial distance 102 substantially longer than the length of the unformed end portion 103 of the can body member. The forming member 160 is freely rotatably mounted on an offset eccentric end shaft portion 164 of shaft means 142. The common central axis 165 of shaft portion 164 and forming member 160 is eccentric to axes 76 and to the central axis 148 of shaft means 142 for locating the forming member 160 within the can body member 30 with only a portion of surface 161 in supporting peripheral engagement with only a portion of the inner cylindrical surface of the can body member as indicated at 166. The forming member 160 is rotatably mounted on roller bearing units 170, 172 supported by a bearing sleeve member 174 rotatably and axially slidably mounted on end shaft portion 164. A spring means, in the form of a compression spring 176 mounted on shaft portion 164 between a fixed retainer nut member 178 and the side surface 180 of sleeve member 174, is provided for axially outwardly biasing the forming member 160 into abutting engagement with a bearing ring member 181 fixed on shaft portion 164 against a shaft shoulder surface 182 while permitting axially opposite displacement along the shaft portion 164.

The inner forming means 140 further comprises an axially outermost second forming member 184 freely rotatably mounted on a central shaft portion 186 of shaft means 142. The forming member means 184 and shaft portion 186 have a common central axis 188 normally coaxial with central axes 76 of housing member 60 and the outer forming surface 94 but eccentrically offset, relative to axis 148 of shaft means 142 and relative to the central axis 165 of the shaft means 164. Forming member 184 has a cylindrical outer surface 190 and is rotatably mounted on roller bearing units 192, 194 supported by a bearing sleeve member 196 rotatably and axially slidably mounted on central shaft portion 186. A spring means, in the form of a compression spring 198 mounted on shaft portion 186 between a fixed retainer nut member 200 and the side surface 202 of sleeve member 196, is provided for axially inwardly biasing the forming member 184 into abutting engagement with a bearing ring member 204 fixed on shaft portion 186 against bearing ring member 181 while permitting axially opposite displacement along the shaft portion 186. A reduced diameter cylindrical peripheral support surface 206 has a diameter approximately equal to the inside diameter of the can body member and intersects a radially extending annular shoulder 210 having a radial width approximately equal to the thickness of the sidewall portion 32 of the can body member to provide abutment and support means for receiving the unformed end portion 34 of the can body member thereon. The outside diameter of surface 161 of forming member 160 is substantially less than the outside diameter of surface 206 and the central axis 165 is offset relative to the central axis 188 so as to provide a sufficient gap 212 between the radially innermost surface of the necked and flanged area of the can body member after the necking and flanging operation to enable axial withdrawal of the formed end portion relative to the forming member 160.

Figure 8:
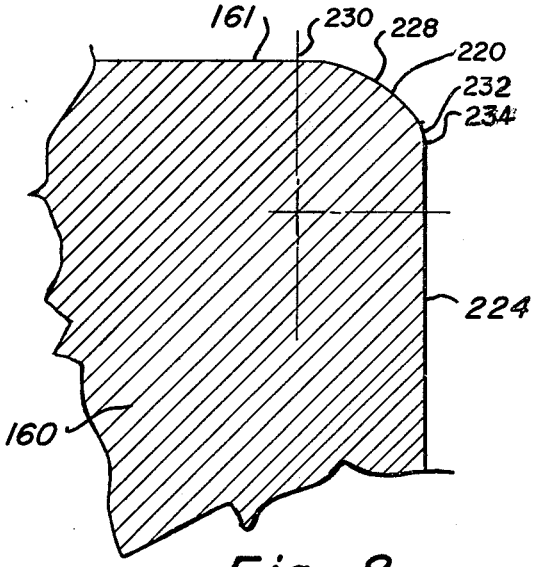
FIG. 8 is an enlarged cross-sectional side elevational view of a portion of the inner forming surface of one of the members of the apparatus of FIG. 8.
Figure 9:
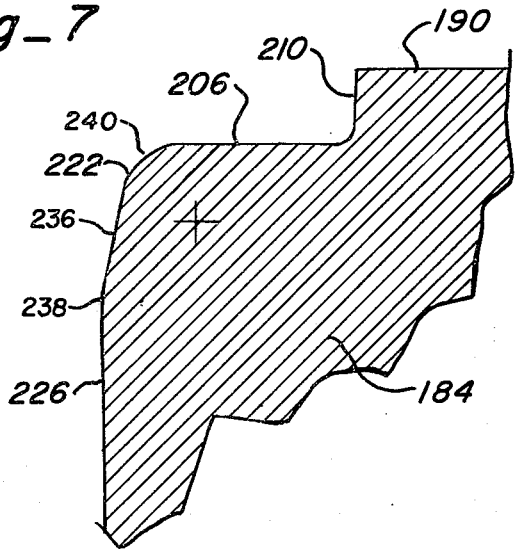
FIG. 9 is an enlarged cross-sectional side elevational view of a portion of the inner forming surface of the other one of the inner forming end support members of the apparatus of FIG. 7.

The inner forming means further comprises first and second axially oppositely displaceable annular inner forming surfaces 220, 222, on the axially adjacent side surfaces 224, 226 of forming members 160, 184, respectively, adapted to abuttingly engage variably axially spaced portions of the inner peripheral surface of the unformed end portion located on axially opposite sides of the plane 104 of the center of curvature 101 of the outer forming surface 94 during the forming operation. As shown in FIG. 8, the annular inner forming surface 220 on member 160 comprises a first axially elongated radially curved portion 228 of relatively large radius extending tangentially from outer surface 161 at 230 to and intersecting at 232 a second radially curved portion 234, of substantially smaller radius extending tangentially from side surface 224. As shown in FIG. 9, the annular inner forming surface 222 on member 184 comprises a first radially elongated inclined surface 236 intersecting side surface 226 and 238 and a radially curved portion 240 tangentially connecting inclined surface 236 to axially extending surface 206.

OPERATION

In operation, one can body member 30 is loaded into each empty pocket 16, as the transfer wheel 14 rotates past the loading chute means 38, with the unformed open end portion facing the outer forming assembly means 20 and inner forming assembly means 24 associated with each pocket. Then, as shown in FIG. 1, the bottom end wall portion 36 of the can body member is associated with a push pad member 250 mounted on the end of an axially slidable ram shaft member 252 which is operatively connected by a cam follower shaft 254 and cam follower roller member 256 to an annular cam groove 258 in an annular cam plate member 260 non-rotatably mounted relative to the center shaft 10. The push pad member 250 may be rotatably mounted on ram shaft 252 by suitable bearing means 262 and a conventional vacuum system may be connected to the push pad member through central axial passage means 264 to hold the can body member on the side surface of the push pad member by vacuum.

The ram shaft member 252 is moved axially by the cam means from a retracted position as shown in FIG. 1, to an extended position (not shown) whereat the can body member 30 is telescopically located in an initial forming position within the self centering sleeve member 114 in the housing means 60, with the unformed open end portion 34 abutting the radial shoulder 210 on the forming member 184, whereat the axially extending support surface 206 of member 184 and the axially extending support surface 161 of member 160 are located within the can body member as illustrated in FIG. 7.

In the initial forming position, the central axes of the can body member 30, the self centering sleeve 114, the outer forming surface 94 of ring member 92, and the inner forming member 184 are generally coaxially aligned with central axis 165 of the inner forming member 160 eccentrically offset in a first direction on one side of axes 76, 188 and the central axis 148 of shaft means 142 eccentrically offset in a second direction on the other side of axes 76, 188. The side surfaces 224, 226 of the inner forming members 160, 184 are held in abutting engagement along the plane 104 of the center of curvature of outer forming surface 94 by spring means 176, 198 and located thereat by ring members 181, 204. The housing 72 and outer forming ring member 92 are being rotated by gear means 68, 70 and self centering sleeve member 114 is centrally located by centrifugal force while being rotatable by the housing 72 and the ring member 92. The can body member 30 is rotatable by and relative to the sleeve member 194. The inner forming members 160, 184 are rotatable by and relative to the can body member.

Then the shaft means 142 is rotatably moved by the associate cam means 149, 150, 152, 154 (FIG. 2) to radially outwardly displace the eccentrically mounted inner forming members 160, 184 and thereby radially outwardly displace one axial segment of the can body member causing forming engagement of the unformed end portion with varying active portions of the rotating annular forming surface 94 of ring member 92. As the housing 60 is rotated, the ball members 130 in cavity 128 act by centrifugal force to hold sleeve member 114 in radially adjustable engagement with the axial length of the outer surface of the can body member next adjacent and axially inwardly of the active portion of the forming surface 94 to provide support therefor preventing buckling of the sidewall by the forming forces. In addition, axially extending and radially aligned segments of the outer peripheral cylindrical surfaces 161, 206 of the inner forming members 160, 184 are engaged with the axial length of the inner surface of the can body member next adjacent the active portion of the forming surface 94. As the housing 60 and ring member 92 are rotated relative to the can body member, the forming surface 94 gradually forms the necked-in portion and attachment flange portion on the can body member as illustrated in FIGS. 10–14. As the forming process proceeds, the inner forming members 160, 184 are gradually forced axially apart by and axially oppositely shifted along shaft portions 164, 186 against the bias of the compression springs 176, 198.

Figure 10:
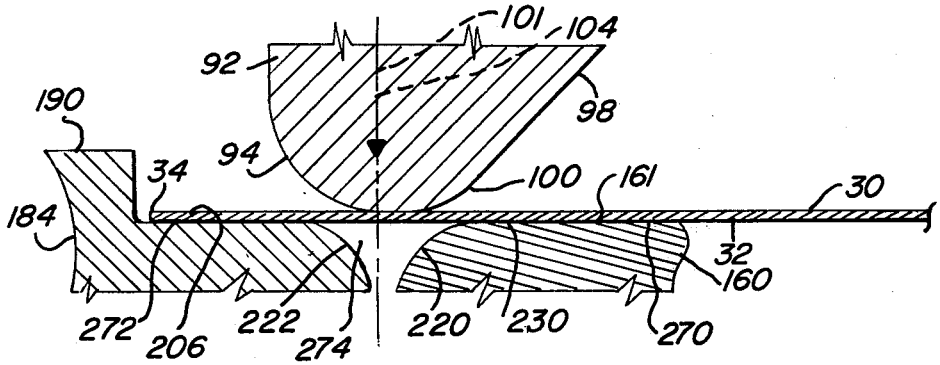
FIG. 10 is an enlarged cross-sectional side elevational view of portions of the outer and inner forming surfaces in the initial forming position.

Referring now to FIG. 10, at the beginning of the forming operation, the unformed end portion of the can body member comprises a cylindrical ring extending axially between the rim portion 34 and the intersection 230 of curved forming surface 220 with the cylindrical outer support surface 161 of forming member 160. Axially aligned and axially spaced and axially extending segments 270, 272 of the inner peripheral surface of the side wall portion 32 are supported by cylindrical surfaces 161, 206 on opposite sides of the plane 104 of the center of curvature 101 of forming surface portion 100 and a forming gap 274 between inner forming surfaces 220, 222.

Figure 11:
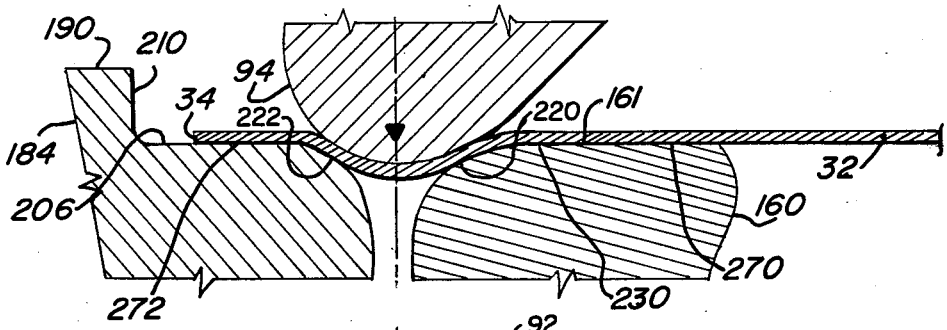
FIG. 11 is an enlarged cross-sectional side elevational view of portions of the outer and inner forming surfaces in a second forming position.

After approximately 25% penetration, as illustrated in FIG. 11, the outer forming surface 94 has been moved radially inwardly relative to inner forming surfaces 220, 222 which have been further axially separated by axially opposite movement of inner forming members 160, 184. The cylindrical support surfaces 161, 206 continue to support inner peripheral surface segments 270, 272 with rim portion 34 being axially inwardly displaced relative to shoulder 210.

Figure 12:
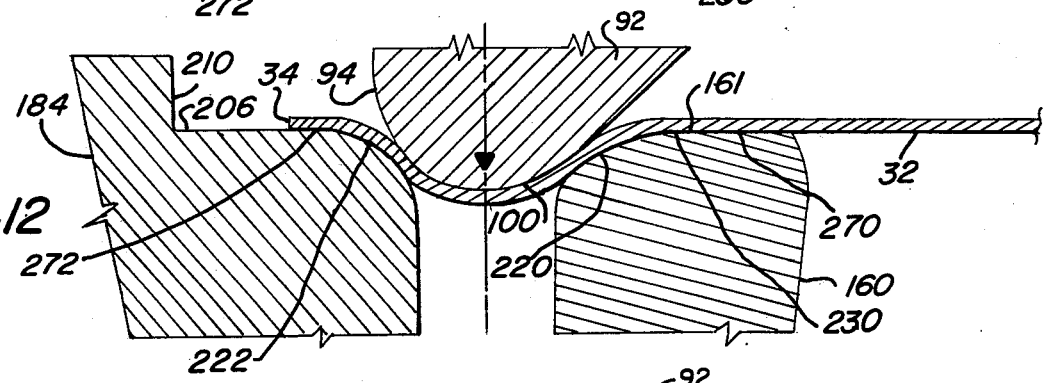
FIG. 12 is an enlarged cross-sectional side elevational view of portions of the outer and inner forming surfaces in a third position.

After approximately 50% penetration, as illustrated in FIG. 12, the outer forming surface 94 has been further moved radially inwardly relative to the inner forming surfaces 220, 222 which have been further axially separated by further axially opposite movement of the inner forming members 160, 184. The cylindrical support surfaces 161, 206 continue to support inner peripheral surface segments 270, 272 with rim portion 34 being further axially inwardly displaced relative to shoulder 210. In this position, the rounded portion 100 of forming surface 94 still provides the predominate force transfer and forming area between the outer forming member 92 and the side wall portion 32 of the can body member while the rounded portions 220, 222 of the inner forming members 160, 184 still provide the predominant force transfer and forming areas between the side wall portion 32 and the inner forming members.

Figure 13:
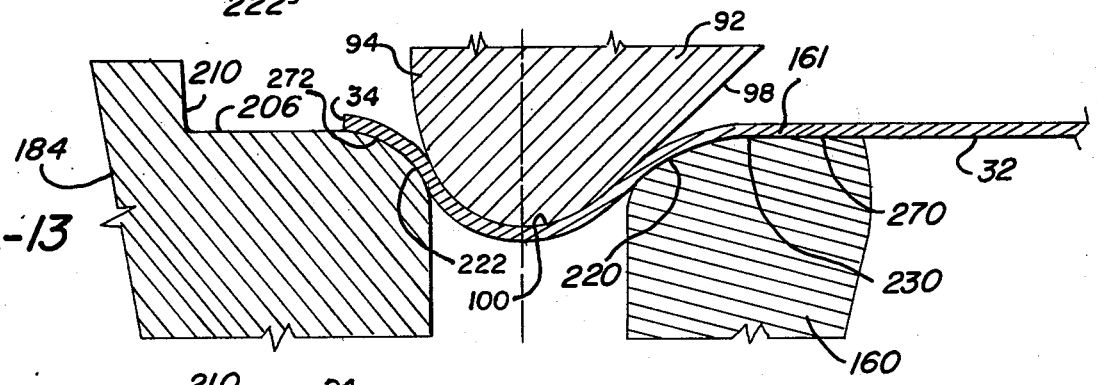
FIG. 13 is an enlarged cross-sectional side elevational view of portions of the outer and inner forming surfaces in a fourth forming position.

After approximately 75% penetration, as illustrated in FIG. 13, the outer forming surface 94 has been still further moved radially inwardly relative to the inner forming surfaces 220, 222, which have been still further axially separated by still further axially opposite movement of the inner forming members 160, 184. The cylindrical support surface 161 continues to support the inner peripheral surface segment 270 but cylindrical support surface 206 no longer engages the inner peripheral support segment 272, the rim portion 34 having been axially displaced relative to shoulder 210 to the point where the forming forces have caused some unimpeded radial outward displacement of the rim portion. In this position both the rounded portion 100 and the inclined portion 98 of the outer forming surface provide force transfer and forming areas between the outer forming member 92 and the side wall portion 32 of the can body member while the rounded portions 220, 222 of the inner forming members 160, 184 still provide the predominate force transfer and forming areas between the side wall portion 32 and the inner forming members.

Figure 14:
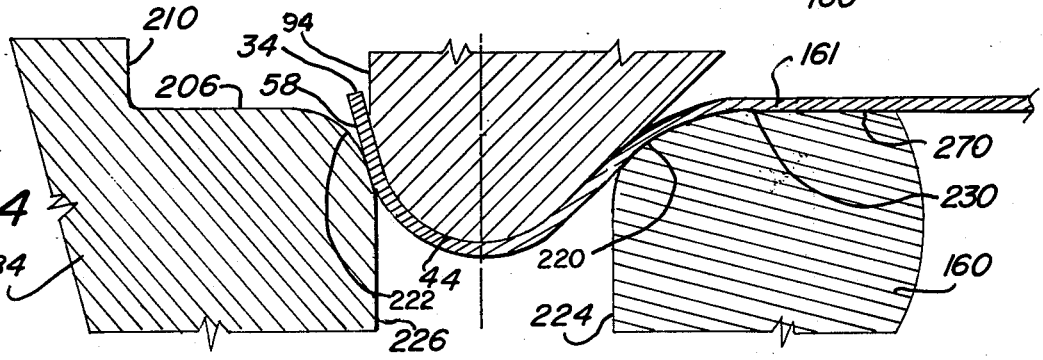
FIG. 14 is an enlarged cross-sectional side elevational view of portions of the outer and inner forming surfaces in a final forming position.

In the final forming position, as illustrated in FIG. 14, the outer forming surface 94 has been fully moved radially inwardly relative to the inner forming surfaces 220, 222, which have been moved to a position of maximum axial separation by full axially opposite movement of inner forming members 160, 184. The cylindrical support surface 161 continues to support the inner peripheral surface segment 270 and there continues to be no engagement between the cylindrical support surface 206 and the inner peripheral support segment 272, the rim portion 34 having been fully axially displaced relative to shoulder 210 and fully radially outwardly turned approximately 90° to form the terminal flange portion 58 and relocate the rim portion 34 without being subject to any compressive forming forces and restriction of radial outward movement while restricting any radial inward movement of the rim portion 34. Thus, in the critical terminal flange portion 58 and the rim portion 34, the possibility of obtaining manufacturing defects, such as cracks, as a result of forming forces, has been substantially reduced and the material of the flange portion and the rim portion remains substantially unworked during the necking and flanging operation thereby facilitating ease of further forming during the seaming operation when an end member is sealingly attached to the flange portion. The curved portion 44 of the can body member is formed by direct radial inward displacement of that portion of the sidewall of the can body member without undesirable substantial axial stress. The outer flange portion 58 is formed with minimal application of force which can result in work hardening of the material making sealing attachment of the end closure member difficult or impossible and which can result in fracture of the material making a defective can body member. During the entire forming operation, an axially elongated segment of the outer peripheral surface of the side wall portion of the can body member, next adjacent the unformed end portion, is continuously supportively engaged by the sleeve member 114 to prevent buckling of the sidewall portion.

When the forming operation is completed, shaft means 142 is rotatably moved in the opposite direction by the associated cam means to radially inwardly displace the formed end portion of the can body member from the engaged position with the forming surface 94 to the disengaged position relative thereto. Then the ram shaft 252 is moved axially from the extended forming position to the retracted position by the associated cam means to relocate the formed can body member in the pocket 16. Then the formed can body member is unloaded from the continuously rotating transfer wheel by the unloading means 40.

The foregoing apparatus implements methods of simultaneously necking and flanging an unformed end portion of a can body member wherein an outer forming member 92 having a curved annular outer forming surface 94 is positioned outside a can body member 30 in radially outward juxtaposition to the outer peripheral surface of an unformed end portion. A first annular inner forming surface 220 is positioned inside the can body member in radially inward juxtaposition to the inner peripheral surface of the unformed end portion opposite a first axially inwardly extending portion of the outer forming surface 94 on one side of plane 104. A second annular inner forming surface 222 is positioned inside the can body member in radially inward juxtaposition to the inner peripheral surface of the unformed end portion opposite a second axially outwardly extending portion of the outer forming surface 94 on the opposite side of plane 104. The entire circumference of a first portion of the inner peripheral surface of the can body member between the rim portion 34 and the second annular inner forming surface is supportively engaged by one or more of surfaces 206, 222 throughout the forming operation. An axially elongated segment 270 of the circumference of a second portion of the inner surface of the can body member extending axially inwardly between the first annular inner forming surface 220 a substantial distance beyond the unformed end portion is supportively engaged by surface 161 throughout the forming operation. The outer forming surface 94 is progressively radially inwardly displaced relative to the side wall portion 32 of the can body member against the outer peripheral surface of the unformed end portion to force axially spaced interior surface portions of the unformed end portion into generally conforming engagement with the first and second annular inner forming surfaces 220, 222, at axially spaced locations thereon. The first and second annular inner forming surfaces are progressively axially oppositely displaced as the outer forming surface 94 is progressively radially inwardly displaced relative to the side wall portion 32 of the can body member. Thus, an axially limited length of the entire circumference of the first portion 272 of the inner peripheral surface of the can body member is continuously supported throughout the forming operation while maintaining the rim portion 34 at or radially outwardly of the outer peripheral portion of the can body member without subjecting the form flange portion 58 or the rim portion 34 to any compressive forming stresses.

In this manner, the entire inside surface of the unformed end portion along an annular support area of gradually decreasing axial width extending axially between the axially outermost rim portion 34 of the can body member and the plane 104 of the center of curvature 101 of the curved groove portion 44 formed therein. At the same time, an axially extending circumferentially limited portion 270 of the inside surface of the unformed end portion, extending between the plane 104 of the center of curvature 101 of the curved groove portion 44 to be formed therein and to the plane of and substantially axially inwardly beyond the plane of the intersection 230 of the side wall portion 32 and the curved flange portion 50. The forming surfaces 94, 220, 222 are effective to simultaneously apply radially inwardly and axially inwardly directed forming forces to only one surface portion of limited circumferential length and radial width on the outer periphery of the unformed end portion along the plane 104 of the center of curvature 101 of the annular groove portion 44 to be formed therein. The axially opposite movement of the forming surfaces 220, 222, causes progressively increasing axial spacing between the support areas. The relative rotational movement between the can body member and the forming surfaces 100, 220, 222 causes circumferential changing of the location of the application of the forming forces and the relative radial movement therebetween results in gradually increasing the magnitude of the forming forces.

While the die assembly means and the tool assembly means have been disclosed in connection with illustrative and presently preferred supporting and actuating apparatus, it is recognized that the principles of operation of the die means and the tool means may be variously otherwise embodied and modified without departing from certain of the inventive concepts. For example, the housing means 60 and the forming ring member 92 may be fixedly mounted relative to the tool shaft means 142 which may be rotatably driven by suitable drive means. In addition, the can body member may be rotatably driven relative to the forming ring member 92 and/or the roller members 160, 184 by suitable drive means. Thus, varying relative rotational movements may be provided between the can body member and the housing means 60, the support sleeve 114, the forming ring member 92, the forming members 160, 184, and the shaft means 142 by various means without changing the general forming method and apparatus disclosed herein. In addition, the configuration of forming surfaces 100, 220, 222 may be modified to produce necked and flanged portions of varying configurations.

It is intended that the claims be construed to include alternative embodiments of the inventive concepts disclosed herein except insofar as limited by the prior art.

I claim:

1. Apparatus for simultaneously necking and flanging an unformed end portion next adjacent a rim portion of a side wall portion of a sheet metal can body member to form a curved necked-in wall portion in the unformed end portion next adjacent and connected to the side wall portion and to form a radially and axially outwardly extending flange portion between the formed curved necked-in portion and the rim portion; and comprising:

support means for supporting the can body member during a necking and flanging operation;

outer forming means mounted without the can body member in radially outwardly spaced relationship to and in axial alignment with the unformed end portion and having a curved annular outer forming surface extending therearound for engaging circumferentially variable portions of the outer peripheral surface of the unformed end portion to form the curved necked-in portion and the flange portion;

inner forming means mounted within the can body member in radially inwardly spaced relationship to and in axial alignment with the unformed end portion and having first and second axially oppositely displaceable annular inner forming surfaces for engaging axially spaced portions of the inner peripheral surface of the unformed end portion located on axially opposite sides of the center of curvature of the curved annular outer forming surface to form the curved necked-in portion and the flange portion while preventing radial inward displacement of the rim portion; and actuating means for causing relative rotational movement between said can body member and said outer forming means and for causing relative radial displacement between said can body member and said outer forming means to engage said curved annular outer forming surface with circumferentially variable portions of the outer peripheral surface of said unformed end portion and progressively move the curved annular outer forming surface radially inwardly relative to the can body member until the curved necked-in portion and the flange portion have been formed in the unformed end portion.

2. The invention as defined in claim 1 and wherein said inner forming means comprises:

a first axially innermost forming member having a cylindrical support surface extending axially inwardly from a position adjacent to the axially innermost portion of the unformed end portion a distance sufficient to engage a portion of the inner peripheral surface of the can body member extending axially inwardly a substantial distance beyond the unformed end portion;

the first axially displaceable annular inner forming surface being located on one end of said first roller forming member next adjacent the center of curvature of said curved annular outer forming surface;

a second axially outermost forming member having a cylindrical support surface extending axially outwardly between the center of curvature of said curved annular outer forming surface and the rim portion and having an outer diameter approximately equal to the inside diameter of the can body member for supportive engagement with and for preventing radial inward movement of the rim portion during the forming operation; and the second axially displaceable annular inner forming surface being located on one end of said second roller forming member next adjacent the center of curvature of said curved annular outer forming surface.

3. The invention as defined in claim 2 and further comprising:

support shaft means for supporting said first forming member and said second forming member; and bearing means for rotatably supporting said first forming member and said second forming member on said support shaft means.

4. The invention as defined in claim 3 and further comprising:

mounting means for said first forming member and said second forming member enabling axial opposite movement thereof between the first initial forming position in closely spaced axial relationship and variably axially oppositely spaced subsequent forming positions.

5. The invention as defined in claim 4 and further comprising:

spring means associated with said first forming member and said second forming member for biasing said first forming member and said second forming member to the initial forming position and for enabling axially opposite movement thereof from the initial forming position to the variably axially oppositely spaced subsequent forming positions in response to increased forming forces.

6. The invention as defined in claim 5 wherein said support means comprising:

a housing means having an axially elongated cylindrical bore having a diameter larger than the outside diameter of the can body member for receiving the can body member therewithin;

a self centering radially displaceable sleeve means having a central cylindrical bore with a diameter approximately equal to the outside diameter of the side wall portion of the can body member and providing an axially extending cylindrical support surface for supportively engaging an axially elongated portion of the outer peripheral surface of the side wall portion next adjacent to and extending axially inwardly from the unformed end portion and for enabling radial displacement of the can body member relative to said curved annular outer forming surface during the forming operation while continuously supporting the outer peripheral surface of the side wall portion next adjacent to and extending axially inwardly from the unformed end portion.

7. The invention as defined in claim 6 and wherein:

said outer forming means being mounted on said housing means with said curved annular outer forming surface being located circumjacent said unformed end portion and axially positioned next adjacent the axially outermost end portion of said sleeve means.

8. The invention as defined in claim 7 and wherein said actuating means comprising:

rotational means associated with said housing means and said outer forming means for causing rotation of said housing means and said outer forming means relative to the can body member.

9. The invention as defined in claim 8 and further comprising:

sleeve mounting means for mounting said sleeve means in said housing means and for enabling rotational movement of said sleeve means relative to said housing means and said outer forming means.

10. The invention as defined in claim 9 and wherein said actuating means further comprising:

radial displacement means associated with said inner forming means for causing progressive radial displacement of said inner forming means and the can body member toward said outer forming means to cause progressive radial inward movement of said annular curved forming surface relative to the unformed end portion.

11. The invention as defined in claim 10 and wherein said support shaft means comprising:

a first axially outermost shaft portion having a first central axis and being movable radially by said radial displacement means relative to the central axis of said curved annular outer forming surface between a first non-forming position and variably progressively displaced forming portions;

a second intermediate shaft portion connected to and movable radially with and located next adjacent and axially inwardly of said first axially outermost shaft portion, and having a second central axis eccentrically radially outwardly offset relative to said first central axis, and said second axially outermost forming member being coaxially rotatably mounted on said second intermediate shaft portion and movable radially therewith;

a third end shaft portion connected to and movable radially with and located next adjacent and axially inwardly of said second intermediate shaft portion, and having a third central axis eccentrically radially outwardly offset relative to said first central axis and said second central axis, and said first axially innermost forming member being coaxially rotatably mounted on said third end shaft portion and movable radially therewith:

12. The invention as defined in claim 9 and wherein said sleeve mounting means comprising:

an axially extending annular slot in said housing means defined by an inner peripheral surface of substantially greater diameter than the inner peripheral diameter of said curved annular outer forming surface and a pair of axially spaced radially inwardly extending abutment surfaces, said sleeve means having an outer peripheral surface of less maximum diameter throughout than the inner peripheral surface of said annular slot and having a pair of axially spaced radially outwardly extending abutment surfaces slidably engageable with said pair of axially spaced radially inwardly extending abutment surfaces, the outer peripheral surface of said sleeve means being radially spaced from and located radially inwardly of said inner peripheral surface of said slot, said inner peripheral surface of said slot and the outer peripheral surface of said sleeve means and portions of said axially spaced radially inwardly extending abutment surfaces defining an axially extending annular chamber between said housing means and said sleeve means, and radially displaceable load bearing means mounted in said chamber for normally causing self centering movement of said sleeve means to a centered position of generally coaxial alignment with said curved annular outer forming surface and for enabling radially outward displacement of said sleeve means during the forming operation while maintaining a load bearing relationship between the outer peripheral surface of said sleeve means and the inner peripheral surface of said slot.

13. The invention as defined in claim 12 and wherein said load bearing means comprising:

a multitude of ball members of relatively small diameter confined in said chamber and being radially and axially displaceable therewithin to enable radial displacement of said sleeve means.

14. The invention as defined in claim 13 and wherein:

said outer peripheral surface of said sleeve means having a pair of oppositely inclined surface portions intersecting one another centrally of said sleeve means and defining a minimum diameter portion of the outer peripheral surface of the sleeve means at the intersection and extending axially oppositely radially outwardly between the intersection and said radially outwardly extending abutment surfaces.

15. The invention as defined in claim 14 and wherein:

said inner peripheral surface of said slot having a pair of oppositely inclined surface portions located radially opposite said pair of oppositely inclined surface portions on said sleeve means.

16. The invention as defined in claim 15 and wherein:

said outer peripheral surface of said sleeve means including a plurality of circumferentially extending grooves having radially outwardly inclined side surfaces.

17. The invention as defined in claim 16 and wherein:

one of said radially inwardly extending abutment surfaces on said housing means being next adjacent said curved outer annular forming surface.

18. The method of simultaneous necking and flanging of an unformed end portion including a rim portion of the side wall portion of a sheet metal can body member to form a curved necked-in portion connected to the side wall portion and a radially and axially outwardly extending flange portion between said necked-in portion and said rim portion, and comprising:

positioning an outer forming member having a curved annular outer forming surface outside the can body member in juxtaposition to the outer peripheral surface of the unformed end portion, and positioning a first annular inner forming surface inside the can body member in juxtaposition to the inner peripheral surface of the unformed end portion radially inwardly opposite a first axially inwardly extending portion of the outer forming surface, and positioning a second annular inner forming surface inside the can body member in juxtaposition to the inner peripheral surface of the unformed end portion radially inwardly opposite a second axially outwardly extending portion of the outer forming surface;

supportively engaging the entire circumference of a first portion of the inner peripheral surface of the can body member extending between the rim portion and said second annular inner forming surface, and supportively engaging an axially elongated segment of the circumference of a second portion of the inner surface of the can body member extending axially inwardly beyond said first annular inner forming surface a substantial distance beyond the unformed end portion;

causing progressive radial inward relative displacement of the outer forming surface relative to the side wall portion of the can body member against the outer peripheral surface of the unformed end portion and forcing axially spaced interior peripheral surface portions of the unformed end portion into generally conforming engagement with said first annular inner forming surface and said second annular inner forming surface;

progressively axially oppositely displacing said first annular inner forming surface and said second annular inner forming surface as said outer forming surface is progressively radially inwardly displaced relative to the side wall portion of said can body member; and continuously supporting at least an axially limited length of the entire circumference of the first portion of the inner peripheral surface of the can body member throughout the forming operation while maintaining the rim portion at or radially outwardly of the outer peripheral surface of the side wall portion of the can body member and without subjecting the formed flange portion to any compressive stresses.

19. The method of simultaneously necking and flanging an unformed end portion of a cylindrical side wall portion of a metallic can body member to provide an annular rim portion located on the open end of the can body member and having an outside diameter equal to or less than the outside diameter of the side wall portion, an axially and radially inwardly extending annular first flange portion located axially inwardly next adjacent the rim portion, an annular curved groove portion located axially inwardly next adjacent the first flange portion and having an outside diameter less than the rim portion, and an axially inwardly radially outwardly extending second flange portion located axially inwardly next adjacent the curved groove portion and connecting the curved groove portion to the side wall portion, and comprising the steps of:

initially supporting the entire inside surface of the unformed end portion along an annular support area having a width extending axially between the axially outermost rim portion of the can body member and the plane of the center of curvature of the curved groove portion to be formed therein;

initially supporting an axially extending circumferentially limited portion of the inside surface of the unformed end portion extending between the plane of the center of curvature of the curved groove portion to be formed therein and to the plane of and substantially axially inwardly beyond the plane of the intersection of the side wall portion and the second flange portion;

simultaneously applying radially inwardly and axially inwardly directed forming forces to only one surface portion of limited circumferential length and radial width on the outer periphery of the unformed end portion along the plane of the center of curvature of the annular curved groove portion to be formed; and circumferentially changing the location of application of the forming forces and gradually increasing the magnitude of the forming forces while axially widening the distance between the annular support area and the axially extending circumferentially limited portion of the inside surface of the unformed end portion.

20. The method of simultaneously necking and flanging of an unformed end portion, next adjacent the rim portion of the side wall portion of a sheet metal can body member to form a curved necked-in portion in the unformed end portion next adjacent and connected to the side wall portion and to form a radially and axially outwardly extending formed flange portion between the formed curved necked-in portion and the rim portion, and comprising:

locating a curved annular outer forming surface circumjacent and in radially outwardly spaced relationship to the unformed end portion;

movably holding and supporting interior surfaces of and in and adjacent to the unformed end portion of the side wall portion of the can body member;

providing an annular forming gap radially inwardly of the unformed end portion radially opposite the center of curvature of the forming surface;

causing progressive radial inward movement of the forming surface relative to the can body member against the outer peripheral surface of the unformed end portion;

holding the interior surface of the unformed end portion at axially spaced areas of abutment on axially opposite sides of the center of curvature of the forming surface;

gradually increasing the radial inward location of the forming surface relative to the can body member while simultaneously progressively increasing the axial distance between the axially spaced areas of abutment on the interior surfaces of the unformed end portion; and maintaining the radial location of the rim portion at or radially outwardly of the outer peripheral surface of the side wall portion of the can body member throughout the forming operation without subjecting the flange portion of any compressive stresses.

* * * * *